United States Patent [19]

Smith

[11] 4,290,591

[45] Sep. 22, 1981

[54] HAND TOOL FOR HOLDING ELECTRICAL OUTLET BOXES DURING INSTALLATION TO A STUD OR OTHER STRUCTURAL MEMBER

[76] Inventor: Sylvester J. Smith, Rte. E, Box 140A, Newport, Oreg. 97365

[21] Appl. No.: 187,436

[22] Filed: Sep. 15, 1980

[51] Int. Cl.[3] ..... B25B 3/00

[52] U.S. Cl. ..... 269/6; 33/174 R; 33/DIG. 10; 269/904

[58] Field of Search ..... 269/6, 257, 904; 81/420, 5.1, 367; 33/174 R, DIG. 10; 29/281.5

[56] References Cited

U.S. PATENT DOCUMENTS 3,601,386 8/1971 Estep ..... 269/6

3,617,044 11/1971 Strange ..... 269/6

OTHER PUBLICATIONS

Photograph of "Visegrips" Manufactured by Peterson Mfg. Co.

*Primary Examiner*—Robert C. Watson

*Attorney, Agent, or Firm*—Klarquist, Sparkman, Campbell, Leigh, Hall & Whinston

[57] ABSTRACT

A hand tool is described for holding the front of an electrical outlet box a predetermined distance outwardly beyond the front surface of a stud or other structural member as the box is installed so that when wallboard or other finish material is mounted to the stud, the front of the box is flush with the wallboard. The tool includes jaws for gripping a side panel of the outlet box, indicia for indicating the depth which the side panel is inserted into the jaws, and a spacing member which engages the stud and establishes the predetermined distance between the front surface of the stud and the front of the electrical outlet box. The tool also may include an elevation establishing device for spacing the electrical outlet box a desired distance above the floor. In one embodiment, the indicia comprise pins which limit the depth to which the side panel can be inserted into the jaws. Also, in this embodiment the spacing member comprises first and second spacing bars detachably mounted to the pins. These bars are positioned such that one of the bars is at least partially within the electrical outlet box while the other engages the stud and vice versa depending upon which side panel of the electrical outlet box is gripped and the orientation of the tool. These bars may be replaced to vary the predetermined distance to accommodate wallboard of different thickness.

9 Claims, 3 Drawing Figures

FIG. 1
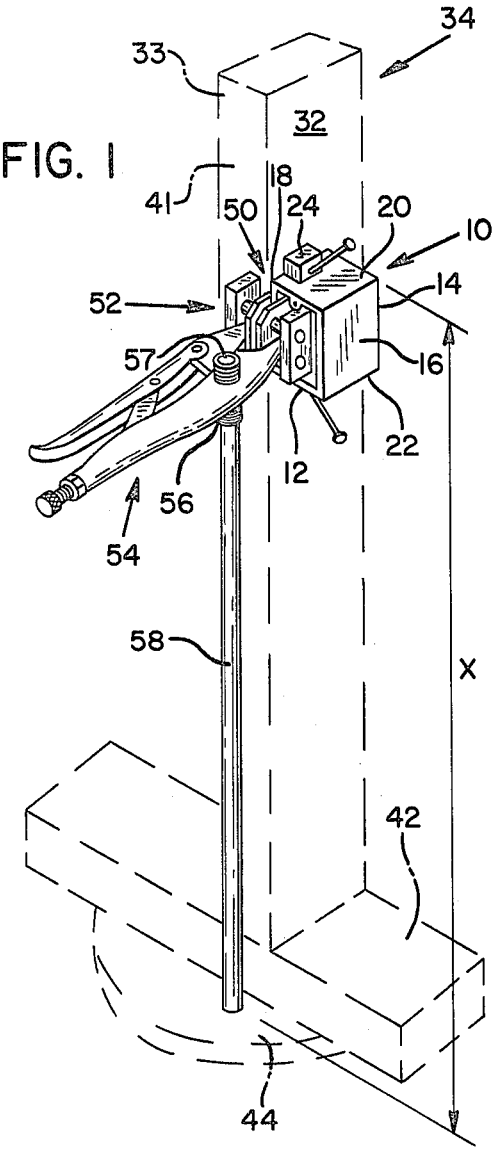
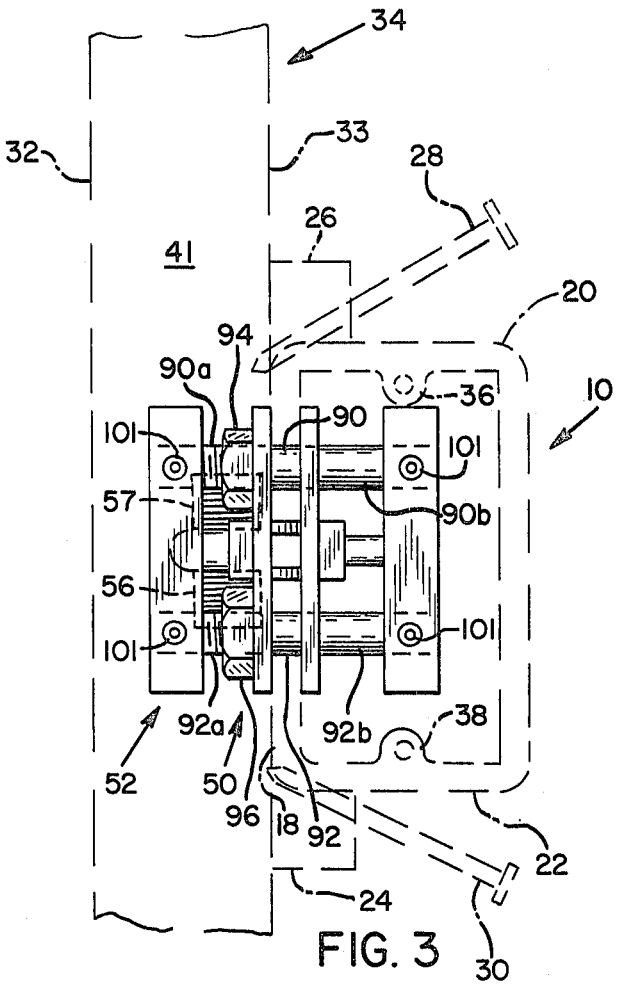
FIG. 3
FIG. 2
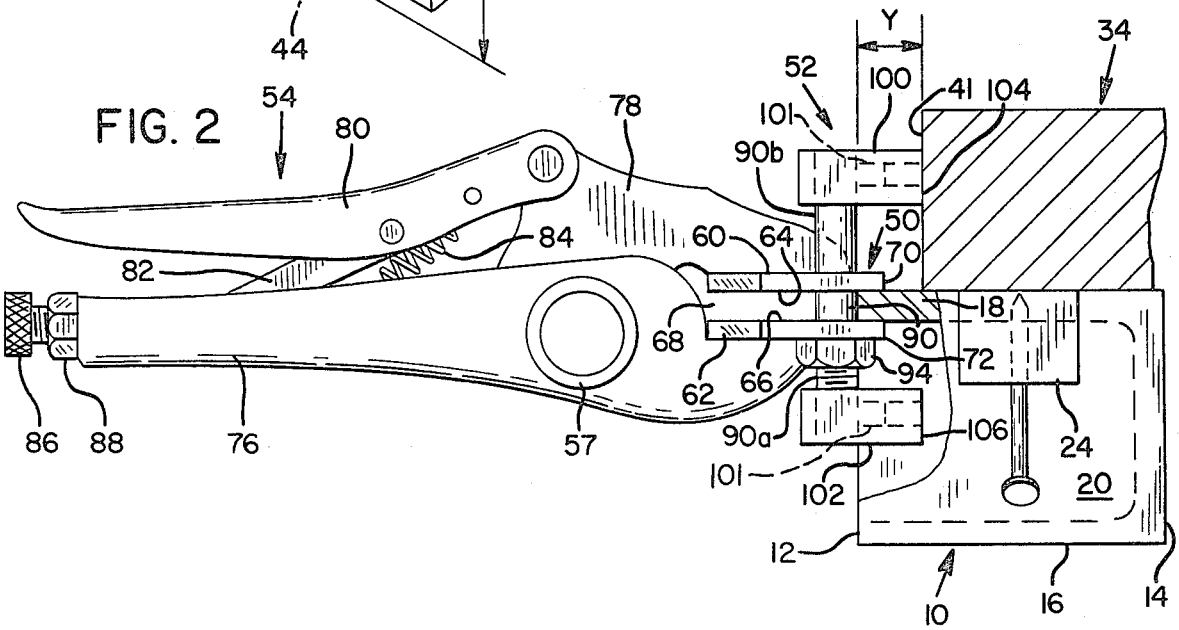

HAND TOOL FOR HOLDING ELECTRICAL OUTLET BOXES DURING INSTALLATION TO A STUD OR OTHER STRUCTURAL MEMBER

BACKGROUND OF THE INVENTION

1. Field of the Invention

The present invention relates to hand tools for holding electrical outlet boxes during installation to a structural member such as a wooden stud.

2. Description of the Prior Art

Electrical switches, receptacles, and the like are positioned within electrical outlet boxes which are normally installed at the time a structure is wired. These electrical outlet boxes are usually mounted to a stud or other structural member and, because of esthetic and building code requirements, must be installed so that the front of the box is approximately flush with wallboard (sheetrock) or other wall finishing materials applied to the studs after the outlet boxes have been installed and wiring is complete. In other words, the front of the electrical outlet boxes must be spaced outwardly from the front of the stud so that it will be flush with the finished wall materials when the structure is complete.

In addition, for esthetic and other reasons, outlet boxes are typically positioned a uniform distance or elevation above the floor, or subfloor of a structure. Significant variations in elevation of electrical outlet boxes are detectable by the human eye and detract from the overall appearance of the completed building. In addition, unless the switches are all at approximately the same height they may be difficult to locate and turn on when entering a dark room.

Heretofore, the proper installation of electrical outlet boxes has been a difficult and time consuming task.

In one prior art method, an individual uses a tape measure and marks the proper elevation of outlet boxes on each stud. Alternately, a stick of a predetermined length is used instead of a tape measure for marking purposes. Thereafter, a piece of plywood or other material of the thickness of the wallboard is placed against the front surface of the stud, the front of the electrical outlet box is held even with the front surface of the plywood, and the box is secured to the stud. This method of installing electrical outlet boxes is extremely time consuming. Furthermore, it is subject to inaccuracies arising, for example, because as the boxes are secured to studs the boxes often shift. This causes them to project too far outwardly from the stud, to not project outwardly far enough from the stud, or to be tilted relative to the front surface of the stud so that the top or bottom of the box projects out too far while the opposite end does not project out far enough. Under such circumstances, the electrical outlet boxes are not flush with the wall materials when installed. Also, errors in measurement and marking studs and resulting differences in elevation of the boxes commonly arise from this method of installation of such boxes.

Therefore, a need exists for a device which solves these and other problems arising during the installation of electrical outlet boxes.

SUMMARY OF THE INVENTION

It is a primary object of the present invention to provide a tool for installation of electrical outlet boxes to a stud or other structural member.

It is another object of the present invention to provide such a tool which positions the front of the electrical outlet box a predetermined distance from the front of the structural member.

It is a further object of the invention to provide such a tool which positions the front of the electrical outlet box a predetermined distance from the front of the stud, and in which the predetermined distance is adjustable.

It is still another object of the invention to provide a tool for holding an electrical outlet box in contact with a structural member a predetermined elevation above the floor level.

Still another object of the invention is to provide a tool for installing electrical outlet boxes which is versatile, mechanically simple, reliable, and easy to use.

A further object of the invention is to provide a tool for installing electrical outlet boxes which is capable of securely gripping electrical outlet box side panels of widely varying thicknesses.

It is another object of the invention to provide such a tool which includes an adjustment locking mechanism for selectively locking the tool in gripping engagement with electrical outlet boxes.

It is still another object of the invention to provide a tool capable of gripping either side panel of an electrical outlet box, simultaneously positioning the outlet box a predetermined distance above the floor, and also positioning the front of the electrical outlet box a predetermined distance from the front of a stud or other structural member.

It is another object of the invention to provide a tool which increases the speed of installation of electrical outlet boxes.

It is another object of the invention to provide a tool which improves the accuracy of installation of electrical outlet boxes.

The foregoing and other objects, features and advantages of the present invention will become more apparent from the following detailed description, which proceeds with reference to the accompanying drawings.

BRIEF DESCRIPTION OF THE DRAWINGS

In the drawings:

FIG. 1 is a perspective view of an electrical outlet box installation tool in accordance with the invention;

FIG. 2 is a top plan view of the tool of FIG. 1; and

FIG. 3 is an end view of the electrical outlet box installation tool of the invention.

DETAILED DESCRIPTION OF PREFERRED EMBODIMENT

With reference to FIG. 1, the preferred embodiment of a hand tool in accordance with the present invention for holding electrical outlet boxes during installation is illustrated.

For purposes of explanation, and not to be construed as a limitation, the tool is described in conjunction with a standard electrical outlet box 10. Such a box has a front 12 in one plane, a back panel 14, side panels 16, 18, and end panels 20, 22. The end panels are each provided with exterior nailing flanges 24, 26. Nails 28, 30 are driven through these flanges into a side wall 32 of a structural member such as a wooden stud 34 to mount the electrical outlet box to the stud. The outlet boxes also include receptacle outlet mounting flanges 36, 38. Such flanges project inwardly toward the center of the box from the interior surface of the respective end panels 20, 22. Screws are commonly used to attach an electrical switch or receptacle (not shown) to these mounting flanges during wiring of the structure.

In addition, stud 34 projects upwardly from a plate 42 which in turn is fastened to a floor or subfloor 44 of the structure. It is to be emphasized that the above described environment is illustrative only and that the tool, which will be subsequently described, is suitable for use during installation of any of a wide variety of electrical outlet and other boxes.

As mentioned above, the hand tool is provided with a means for securely holding the electrical outlet box during its installation to stud 34. This means may take the form of cooperating gripping jaw means indicated generally at 50. In addition, the tool includes means such as a spacing member 52 for positioning the front 12 of the electrical outlet box a predetermined distance, such as Y in FIG. 2, outwardly from the front surface 41 of the stud. This distance is established to be approximately equal to the thickness of wallboard or other wall finishing materials subsequently overlayed on and mounted to studs 34. Consequently, when installation of the wallboard is complete, the front of the electrical outlet box is substantially flush with the surface of the finished wall. Furthermore, the tool includes a handle means indicated generally at 54 for operating the box holding means to hold the box in place as it is nailed. In addition, the tool includes means for spacing the electrical outlet box a predetermined elevation or distance, X in FIG. 1, above the floor 44.

This last mentioned means may take the form of internally and externally threaded fasteners 56, 57 adapted to receive a spacing rod 58 of a predetermined length, which when rested upon the floor 44 establishes the distance X. For floor level receptacle boxes, X is typically established at from twelve to eighteen inches, for counter top receptacle boxes X is typically established at from forty-four to forty-eight inches and for wall switch receptacle boxes X is typically established at forty-eight inches.

With reference to FIG. 2, box holding means 50 comprises first and second planar plate-like jaws 60, 62. Each jaw 60, 62 has a respective planar box gripping surface 64, 66 supported by the handle means 54 in lateral spaced relationship such that the box gripping surfaces 64, 66 define a throat 68 between them. The free ends 70, 72 of the respective jaws 60, 62 are straight edged and parallel to one another so that they define a mouth between them through which side panel 18 is insertable into the throat. Once the side panel is inserted into the throat 68, handle means 54 are operable to open and close the jaws to alternately release and grip the inserted side panel.

Handle means 54 may take the form of a self-locking plier mechanism having a first handle section 76 which supports jaw 62, a jaw section 78 which supports jaw 60, and a second handle section 80 pivoted to jaw section 78. Handle means 54 also includes a link 82 pivoted to handle 80 and slidable within a slot (not shown) in handle section 78, a biasing spring 84, and a threaded adjustment device such as bolt 86. Such a handle means is operable in a well known manner as follows. When handle 80 is drawn toward handle 76, jaws 60 and 62 close an amount determined by the setting of adjustment bolt 86. Furthermore, when bolt 86 is properly adjusted, after jaws 60, 62 engage the inserted side panel 18 of the outlet box, handles 80 and 76 can be drawn together somewhat further. This additional motion of handles 80 and 76 locks the jaws in gripping engagement with the inserted side panel. Adjustment of bolt 86 adjusts the degree of opening and closing of jaws 60, 62 so that they are capable of gripping outlet boxes having side panels of varying thicknesses.

The above described handle means is similar to a prior art locking pliers sold under the trademark VICE GRIPS. However, unlike the prior art pliers, applicant's handle means includes a locking mechanism such as a nut 88 mounted to adjustment bolt 86. When tightened, nut 88 prevents turning of the adjustment bolt and locks this adjustment bolt in one position. After nut 88 is loosened, adjustment bolt 86 can be turned to another position. After readjusting bolt 86, nut 88 can again be tightened to lock bolt 86 in place. The majority of electrical outlet boxes installed at a particular job site have side panels of a constant thickness. Hence, by adjusting bolt member 86 to permit the jaws to close and grasp boxes of such a constant thickness, and by setting locking mechanism 88 to prevent further movement of adjustment bolt 86, the jaws automatically grip the side panels of such boxes when the handles 76, 80 are closed.

The hand tool also includes indicia means for indicating the depth the electrical outlet box side panel 18 is inserted into the throat. Such indicia means may take the form of a visually observable stop member, such as first and second pins 90, 92 mounted to jaw 62, which limit the depth the side panel 18 is insertable into the jaws. Pins 90, 92 are normal to a first line which is parallel to edges 70, 72 of the jaws. In addition, pins 90, 92 are parallel to the plane containing the front 12 of the electrical outlet box when the box is inserted into the throat 68 with the front edge of side panel 18 abutting pins 90, 92. These pins each include a central portion which spans the throat, a first pin extension portion **90*a*, 92*a* extending through an opening in the jaw 62 and projecting outwardly beyond this jaw, and a second pin extension portion 90*b*, 92*b* extending through an opening in jaw 60 and projecting outwardly beyond this jaw. Each pin is also generally perpendicular to jaw 62 and threadedly mounted thereto by a nut 94, 96 spot welded or otherwise secured to its outer surface. Hence, these pins 90, 92 can be readily removed for replacement or other purposes as desired. These pins are also slidable relative to jaw 60** so that they do not interfere with the opening of and closing of the jaws.

Spacing members 52 preferably comprise first and second elongated spacing bars 100, 102 each positioned at an opposite side of the throat 68 from the other. Each spacing bar also has respective planar structural member engaging surfaces 104, 106. These spacing bars are generally rectangular in cross section and are sized less than the interior dimension of the electrical outlet box.

Also, spacing bar 100 is releasably mounted to the second pin extensions **90*b*, 92*b* of the respective pins 90, 92. The structural member engaging surface 104 of bar 100 is parallel to and spaced the predetermined distance Y from the plane containing the front of an electrical outlet box when the side panel of the box is inserted against the pins. Hence, as shown in FIG. 2, when the tool grips an electrical outlet box and surface 104 is placed against the front surface 41 of stud 34, the front surface of the stud is positioned the predetermined distance Y from the plane containing the front of the electrical outlet box. In addition, bar 100 provides a broad planar engaging surface 104, so that the electrical outlet box is not skewed or tilted, for example, with the top being farther out from the stud than the bottom, when it is installed. In addition, because spacing member 100 is releasably secured, by set screws 101 or the like, to pins 90, 92**, it can be removed and replaced with another spacing member of a different size to alter the predetermined distance Y. Thus, different spacing bars can readily be utilized to accommodate wall finishing materials of varying thickness. For example, wallboard or sheetrock is commonly manufactured in three-eighths, half-inch and five-eighths inch thicknesses. Hence, the spacing members may be sized to establish predetermined distances equal to these thicknesses.

Second spacing bar 102 is similar to bar 100 and is releasably mounted to the second pin extensions 90*a*, 92*a* of respective pins 90, 92 with its planar structural engaging surface 106 positioned in the plane of surface 104. Thus, surface 106 is also the predetermined distance from the front of the electrical outlet box inserted against pins 90, 92. Consequently, the tool can be turned 180° from the position shown in FIG. 2, for example, to make it more easily used by a left-handed individual, and the engaging surface 106 placed in contact with surface 41 of the stud during use. In addition, if desired to attach the electrical outlet box in FIG. 1 to the opposite side of the stud. The box can be rotated 180° from the position shown in FIG. 1 to the position shown in FIG. 3. This places spacing member 102 outside of the box while spacing member 100 is positioned partially in the box. In this case, surface 106 abuts stud 41 instead of surface 104.

In addition, as can be best seen in FIG. 3, the upper surface of the spacing bar positioned within the electrical outlet box abuts the lower edge of flange 36. Thus, when a rod or tube 58 of a preselected and appropriate length is installed to the appropriate fastener 56 or 57, whichever is oriented to extend downwardly toward the floor from the handle section 76, the elevation X of the box from the floor is automatically established.

Having illustrated and described the principles of the present invention with reference to one preferred embodiment, it will be apparent to those skilled in the art that the invention permits of modification in both arrangement and detail without departing from such principles. I claim as my invention all such modifications as come within the true spirit and scope of the following claims.

I claim:

1. A hand tool for holding an electrical outlet box for installation to a stud or other structural member comprising:

box holding means for holding the electrical outlet box; and box positioning means connected to said box holding means for spacing the front of the electrical outlet box a predetermined distance from the front of the structural member; and in which said box holding means comprises first and second jaws each having an outlet box gripping surface, and handle means for supporting said jaws in lateral spaced relationship such that the box gripping surfaces of the jaws define a throat therebetween and a mouth through which a side panel of the electrical outlet box is insertable in one direction into the throat, said handle means comprising means for opening and closing said jaws to alternately release and grip a side panel of an electrical outlet box positioned within the throat; and said box positioning means including stop member means supported by at least one of said jaws and positioned at least partially within the throat for limiting the depth of insertion of the side panel of the electrical outlet box into the throat and for aligning the edge of the side panel of the electrical outlet box along a first line and thereby the positioning of the front of the electrical outlet box in a first plane containing the first line; and a first spacing member detachably coupled to the first of said jaws and a second spacing member detachably coupled to the second of said jaws; said spacing members being positioned outside of said throat for engaging the structural member to position the first plane containing the front of the electrical outlet box parallel to a second plane containing the front surface of the structural member and for spacing the front of the electrical outlet box a predetermined distance from the front of the structural member.

2. A hand tool according to claim 1 in which said first and second spacing member means each comprising a spacing bar with a structural member engaging surface which abuts the structural member.

3. A hand tool according to claim 2 in which said stop means comprises a stop member mounted to one of said jaws and positioned along the first line so that it abuts the front edge of the side panel of an electrical outlet box inserted within the throat and thereby limits the depth of insertion of the electrical outlet box into the throat.

4. A hand tool according to claim 1 in which said handle means comprises means for releasably locking said jaws in gripping engagement with a side panel of an electrical outlet box, adjustment means for adjusting said handle means to various positions such that the jaws grip side panels of corresponding various thicknesses and means for selectively locking said adjustment means in a desired position so that the jaws grip boxes having side panels of a thickness corresponding to the position of said adjustment means.

5. A hand tool according to claim 4 in which said box holding means comprises box gripping means for gripping a side panel of the electrical outlet box and said box elevation establishing means comprises an elongated elevation establishing member of a predetermined length projecting downwardly from said box gripping means in a direction parallel to the side panel of the electrical outlet box gripped by said gripping means, so that with the electrical outlet box held in contact with the structural member and the elevation establishing member contacting the floor, the electrical outlet box is spaced a predetermined distance above the floor.

6. A hand tool for holding an electrical outlet box for installation to a stud or other structural member comprising:

first and second plate-like jaws each having a planar outlet box gripping surface;

handle means for supporting said jaws in lateral spaced relationship such that the box gripping surfaces of the jaws define a throat therebetween and a mouth through which a side panel of the electrical outlet box is insertable in one direction into the throat, said handle means comprising means for opening and closing said jaws to alternately release and grip a side panel of an electrical outlet box positioned within the throat;

first and second pins, each pin including a central portion spanning the throat, a first pin extension portion extending through an opening in the first jaw and projecting outwardly beyond the first jaw, and a second pin extension portion extending through an opening in the second jaw and projecting outwardly beyond the first jaw, each pin being generally perpendicular to the first jaw and also mounted to the first jaw and slidable relative to the second jaw, said pins being positioned in a first plane so as to limit the depth of the throat such that when the side panel of the electrical outlet box is inserted within the throat a sufficient distance, the front edge of the side panel abuts the pins and places the front of the electrical outlet box in the first plane;

first and second spacing bars each positioned at an opposite side of the throat from the other and having a planar structural member engaging surface, said spacing bars being sized less than the interior dimensions of the electrical outlet box, said first spacing bar being mounted to the first pin extension portions of said first and second pins with its structural member engaging surface positioned in a second plane parallel to and spaced a predetermined distance in a direction opposite said one direction from the first plane, said second spacing bar being mounted to the second pin extension portions of said first and second pins with its structural member engaging surface positioned in the second plane, whereby insertion of the side panel within the throat with its front edge abutting the pins positions one of said spacing bars within the box and another of said spacing bars outside the box adjacent the side panel so that the structural member engaging surface of said another spacing bar can be placed in contact with the front of the structural member to thereby position the front of the electrical outlet box parallel to and a predetermined distance in the first direction from the front of the structural member.

7. A hand tool according to claim 6 in which said first and second spacing bars are detachably mounted to said first and second pins.

8. A hand tool according to claim 6 in which said first and second pins are detachably mounted to said first jaw.

9. A hand tool according to claim 6 or 7 including a first fastener coupled to said handle means and adapted to support an elongated elevation establishing member of a predetermined length so as to project outwardly from the handle means a predetermined distance in a first direction parallel to the structural member, said tool also including a second fastener coupled to said handle means and adapted to support an elongated elevation establishing member of a predetermined length so as to project outwardly from the handle means a predetermined distance in a second direction opposite the first direction.

* * * * *